United States Patent [19]

Masuda

[11] 3,980,455

[45] Sept. 14, 1976

[54] PARTICLE CHARGING DEVICE AND AN ELECTRIC DUST COLLECTING APPARATUS MAKING USE OF SAID DEVICE

[76] Inventor: Senichi Masuda, 40-10-605, 1 chome, Nishigahara, Kita, Tokyo, Japan

[22] Filed: Aug. 12, 1974

[21] Appl. No.: 496,537

[30] Foreign Application Priority Data

Aug. 14, 1973 Japan ..... 48-91188
Sept. 7, 1973 Japan ..... 48-100904

[52] U.S. Cl. ..... 55/105; 55/138; 55/139; 55/152; 55/154; 317/262 AE

[51] Int. Cl.[2] ..... B03C 3/66

[58] Field of Search ..... 55/129, 130, 136, 137, 55/138, 139, 150, 151, 152, 154, 156; 317/262 AE

[56] References Cited

UNITED STATES PATENTS

| | | | |
|---|---|---|---|
| 1,957,458 | 5/1934 | Horne et al. | 55/123 |
| 2,000,017 | 5/1935 | Heinrich et al. | 55/139 |
| 2,039,094 | 4/1936 | Lissman | 55/137 |
| 2,086,063 | 7/1937 | Brion et al. | 55/139 X |
| 2,440,455 | 4/1948 | White | 55/139 X |
| 2,509,548 | 5/1950 | White | 55/2 UX |
| 3,434,416 | 3/1969 | Testone | 101/416 |
| 3,518,813 | 7/1970 | Werner | 55/444 X |
| 3,599,399 | 8/1971 | Gallen | 118/628 X |
| 3,616,606 | 8/1971 | Vincent | 55/154 X |
| 3,759,014 | 9/1973 | Van Dyken et al. | 55/300 X |
| 3,803,808 | 4/1974 | Shibuya et al. | 55/129 X |

FOREIGN PATENTS OR APPLICATIONS

| | | | |
|---|---|---|---|
| 136,344 | 2/1950 | Australia | 55/130 |
| 519,391 | 5/1953 | Belgium | 55/130 |
| 834,510 | 8/1938 | France | 55/130 |
| 19,733 | 9/1913 | United Kingdom | 55/137 |

*Primary Examiner*—Bernard Nozick
*Attorney, Agent, or Firm*—Price, Heneveld, Huizenga & Cooper

[57] ABSTRACT

A particle charging device is herein disclosed in which discharge electrodes and opposite electrodes are disposed in an opposed relationship, third electrodes being provided in the proximity of each said discharge electrode, and there are provided a high voltage source for applying a periodically varying high voltage between said discharge electrodes and said third electrodes, a D.C. voltage source for applying a D.C. bias voltage between the above described electrodes, and a D.C. high voltage source for applying a D.C. high voltage between said third electrodes and said opposite electrodes, whereby during the periods when the periodically varying high voltage is not applied between said discharge electrodes and said third electrodes, D.C. corona discharge originating from said discharge electrodes may be always suppressed. Also an electric dust collecting apparatus making use of said particle charging device is disclosed herein.

6 Claims, 8 Drawing Figures

PARTICLE CHARGING DEVICE AND AN ELECTRIC DUST COLLECTING APPARATUS MAKING USE OF SAID DEVICE

BACKGROUND OF THE INVENTION

The present invention relates to a particle charging device and an electric dust collecting apparatus especially suitable for charging and collecting a high resistance dust, in which charging of particles is performed by means of a periodically varying voltage such as a repetitive pulse voltage and the like. In a single stage type of electric dust collecting apparatus in which a charging section for charging particles and a collector section for collecting charged particles under an electric field exist within the same space, it is known that by applying a repetitive pulse voltage to discharge electrodes it becomes possible to raise a spark discharge voltage and to prevent an inverse ionization phenomenon. Furthermore, as a method for practicing the aforementioned improvement, a novel system is described in pending U.S. application entitled PARTICLE CHARGING DEVICE FOR USE IN AN ELECTRIC DUST COLLECTING APPARATUS, Ser. No. 460,762 filed on Apr. 15, 1974. In this system, cylindrical third electrodes are provided in the proximity of each discharge electrode, a high voltage that is about to generate a spark discharge being applied between said third electrodes and dust collecting electrodes, a group of ions being produced impulsively by applying a repetitive pulse voltage between said third electrodes and said disharge electrodes, and said group of ions are directed towards the dust collecting electrodes to achieve the charging of electrodes.

In the conventional electric dust collecting apparatus, generally a corona current density is uniquely determined by an electric field in a dust collecting space, while driving of particles is achieved by a large electric field that is about to generate a spark discharge and that is established between third electrodes and dust collecting electrodes. However, in case of employing the aforementioned repetitive voltage pulse, an ion current density $i$ (A/m$^2$) can be varied in accordance with the repetition frequency of the pulse voltage regardless of the electric field, and therefore, control can be made on the ion current density in such manner that as the value of the specific resistance $\rho_d(\Omega\text{-}m)$ of the accumulated dust layer on the dust collecting electrodes is varied the relation of $i \times \rho_d < E_b$ (where $E_b$ represents a breakdown electric field intensity of the dust layer, which amounts to about 10,000 V/m) may be retained, in other words, in such manner that the breakdown of the dust layer may be prevented at all times and thereby occurance of inverse ionization phenomena caused by the breakdown can be suppressed.

In addition, since the group of ions generated impulsively in this case are strongly expanded and dispersed owing to a Coulomb's repulsive force and thus they are distributed uniformly over the dust collecting electrodes, said ion current density $i$ becomes uniform over the all positions, and from this aspect also the occurrence of innverse ionization phenomena at a position where the ion current density $i$ is locally increased can be prevented. Thus, the aforementioned system employing a repetitive voltage pulse is favorable. However, in order to effectively practice the aforementioned system, it must be assured that only upon applying a pulse voltage is the discharge from the discharge electrode realized and during the period the pulse voltage is not applied the discharge electrode is completely shielded by the third electrodes resulting in no discharge current. Otherwise, the ion current flows in a D.C. mode, and it becomes impossible both to control the magnitude of the ion current regardless of the electric field and to make the distribution of the ion current uniform, so that the advantages of the impulse type particle charging system would be lost.

In a practical dust collecting apparatus, it is necessary in view of machining tolerances that the distance between a discharge electrode and an adjacent third electrode of several centimeters or more be chosen. However, if it is so chosen, the shielding effect of the third electrode is greatly reduced, so that it becomes very difficult to suppress a corona discharge from the discharge electrode when the pulse voltage is not applied. Furthermore, even if the shielding effect should be realized under a particular condition, the temperature and dust concentration of the inlet gas will vary from time to time during operation of the apparatus, and accordingly, said particular condition would not necessarily be satisfied, resulting in unstable operation.

SUMMARY OF THE INVENTION

It is an object of the present invention to provide an improved particle charging device and an improved electric dust collecting apparatus making use of said particle charging device, which can completely overcome the aforementioned disadvantages of the impulse type particle charging system, and which can stably charge the particles or can remove the dust at the highest dust collecting efficiency, under the optimum condition responsive to the variation in condition of the inlet gas and the dust therein, always without generating inverse ionization even in the case of a dust having a very high electric resistivity, while utilizing the advantages of the impulse type particle charging system.

According to one feature of the present invention, a particle charging device comprising a discharge electrode (including a wire and a barbed wire) including a corona discharge portion having a smaller radius of curvature for generating a corona discharge and disposed via an insulator in the upstream section within a duct so as to be exposed to the gas flow, an opposite electrode having a larger radius of curvature for drawing a corona current and disposed opposite to and at a predetermined distance from said discharge electrode, and a third electrode having a large radius of curvature and disposed in the proximity of said discharge electrode at a predetermined distance from said opposite electrode as insulated from said discharge electrode and from said opposite electrode, a high voltage source for applying a periodically repetitive high voltage between said discharge electrode and said third electrode, and a D.C. high voltage source for applying a D.C. high voltage between said opposite electrode and said third electrode to establish therebetween a D.C. eletric field which drives the ions generated at said discharge electrode towards said opposite electrode, is characterized in that said device further comprises a D.C. bias voltage source for applying a D.C. bias voltage between said discharge electrode and said third electrode so that during the period when the periodically repetitive high voltage is not applied between the discharge electrode and the third electrode the D.C. corona discharge originating from the discharge electrode may be suppressed at all times.

According to another feature of the present invention, an electric dust collecting apparatus is characterized in that apparatus comprises a particle charging section consisting of the above featured particle charging device, a particle collecting section consisting of two positive and negative groups of particle collecting electrodes to be used for collecting the charged particles, said respective groups of electrodes being disposed downstream of said particle charging section and insulated from each other and opposed to each other at a predetermined distance from each other so that a gas flow may be intercepted thereby, and a D.C. high voltage source for applying a D.C. high voltage between said positive and negative groups of particle collecting electrodes, whereby the dust particles may be charged in the particle charging section by means of an intermittent corona discharge caused by a periodically repetitive high voltage and the charged dust particles may be collected in the particle collecting section by means of a D.C. electric field.

The application of the bias voltage essentially characterizes the present invention, and results in the following advantages:

1. Discharge occurs as impulses at the discharge electrode only during the period when the periodically repetitive high voltage is applied, and during the remaining period the corona discharge can be always suppressed in a reliable manner, so that even with practical dimensions of the discharge electrode, the third electrode and the distance therebetween, and even if the inlet gas condition, the dust concentration and the like should be largely varied, the effectiveness of the impulse type charging system is reliably asured.

2. When a two-stage type of electric dust collecting apparatus is constructed according to the present invention by making use of the particle charging device as a particle charging section, the electrostatic capacity between a third electrode and a discharge electrode is extremely reduced, as a result of the fact that the existing area of both said electrodes between which the periodically repetitive voltage is applied is confined to an essentially very small volume within the particle charging section, and accordingly, the volume and cost of the electric power source for charging can be reduced to an extent that is practically acceptable. Owing to the aforementioned advantages, even in the case of a dust having a specific resistivity of the order of $10^{12}$ ($\Omega$–$m$), charging and collection of the dust particles can be performed very effectively under an optimum condition matched to the variation of the inlet gas condition without generating an inverse ionization, and if this particle charging device is employed in a two-stage type of electric duct collecting apparatus, then it becomes possible to effectively collect and remove the dust particles in the particle collecting section on the downstream side.

Now structures and features of a novel particle charging device according to the present invention and a novel electric dust collecting apparatus making use of said particle charging device as a particle charging section therein will be described in more detail in connection to the preferred embodiments of the present invention illustrated in the drawings, in which:

DETAILED DESCRIPTION OF THE PREFERRED EMBODIMENT

Figure 1:
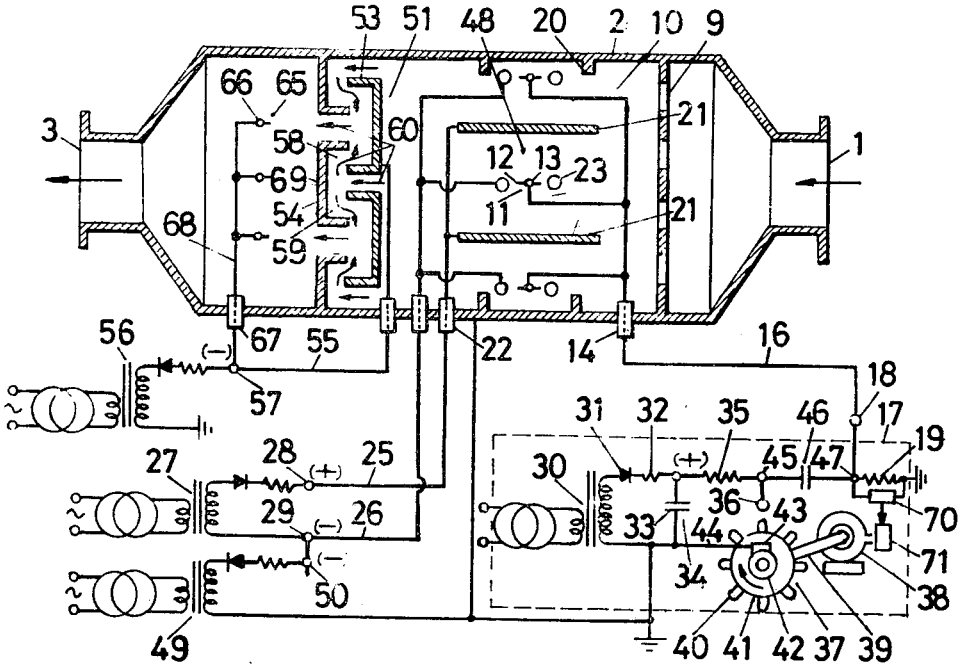
FIG. 1 shows a horizontal cross section view of one preferred embodiment of the present invention together with a circuit diagram of an electric power source for supplying various voltages to an electric dust collecting apparatus.
Figure 2:
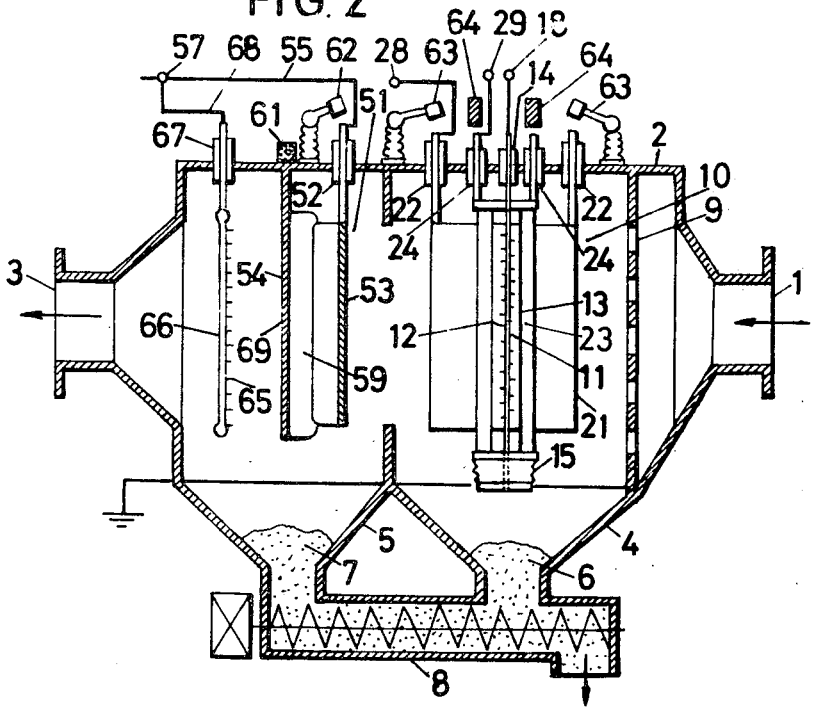
FIG. 2 shows a vertical cross section view of the same embodiment with the electric power source omitted.

Referring now to the drawings, in FIGS. 1 and 2, reference numeral 1 designates an inlet port for introducing a dust-containing gas. Numeral 2 designates a grounded main body duct of a dust collecting apparatus for passing the introduction duct-containing gas therethrough. Numeral 3 designates a gas outlet port for exhausting a cleaned gas. Numerals 4 and 5 respectively designate dust collecting hoppers provided under said duct 2. Numerals 6 and 7 respectively designate dust exhausting ports provided under the respective hoppers 4 and 5 for exhausting the collected dust. Numeral 8 designates a conveyor device for conveying the exhausted dust, and numeral 9 designates a porous plate provided for equalizing the flow velocity of the dust-containing gas introduced through the inlet port 1. Reference numeral 10 designates a particle charging section provided on the upstream side within the duct 2. Numeral 11 designates discharge electrodes each consisting of a vertical cylinder of about 1–3 (cm) in diameter and having discharge portions 12 studded thereabout at predetermined intervals of about 1–10 (cm). Each of said discharge portions 12 being formed of an acicular protrusion of about 1–3 (cm) in length and having a sharp end with a small radius of curvature, said discharge electrode 11 being insulatively supported via an insulating tube 14 and an insulator 15, connected via a conductor 16 to an output terminal 18 of a repetitive high voltage negative pulse source 17, and grounded via a pulse shaping resistance 19 within said pulse source. Reference numeral 20 designates baffle plates for preventing the inlet gas from bypassing the particle charging section. Reference numeral 21 designates a group of vertical planar opposite electrodes insulatively supported by means of insulating tubes 22 and disposed in parallel to each other and to the gas flow. Reference numeral 23 designates a group of third electrodes having a large radius of curvature of about 1–5 (cm) in diameter and insulatively and vertically supported by insulating tubes 24 so as to be disposed in the proximity of the discharge electrode 11 on its opposite sides at a distance of about 1–5 (cm) from the sharp end portions of the discharge electrode 11 and in parallel to said electrode 11, which third electrode consists, in the case of the illustrated embodiment, of a cylindrical body.

Said opposite electrode group 21 and said third electrode group 23 are respectively connected to positive and negative output terminals 28 and 29 of D.C. high voltage sources 27 ( 50 VK ) and 49 ( 20 KV ) via conductors 25 and 26, respectively, and thereby an intense electric field that is about to generate a spark discharge is established between the respective electrode groups 21 annd 23 in such direction that negative ions produced at the discharge electrode 11 may be driven towards the opposite electrodes 21.

Although a pulse source of any structure could be used as the repetitive high voltage negative pulse source 17, in the illustrated embodiment there is used means for generating a repetitive high voltage negative pulse, in which an output terminal voltage of a D.C. high voltage source 34 of positive polarity consisting of a step-up transformer 30, a rectifier 31, a charging resistor 32 and a smoothing capacitor 33, is intermittently grounded with a grounded mechanical rotary switch 37 via a current limiting resistor 35 and a fixed spark electrode 36. Source 17 provides pulses having a peak amplitude of about 14 KV and a frequency range of from 50 to 300 Hz. In this embodiment, the mechanical rotary switch 37 comprises a disc 41 (especially, a conductor disc in the illustrated embodiment) adapted to be driven via a shaft 39 by a variable speed motor 38 so as to rotate in one direction, and having spark electrode pieces consisting of a group of grounded projection electrodes for generating a spark mounted at equal intervals along its circumference. The disc 41 is grounded via a slip ring 42, a brush 43 and a conductor 44.

In operation, as said disc 41 is rotated, each of the projection electrodes 40 around the circumference of the disc 41 successively passes in proximity to the fixed spark electrode 36. Each time it passes through the proximity of the electrode 36 a spark discharge occurs between the projection electrode 40 and the fixed spark electrode 36 which is then at the same potential as the output terminal of the D.C. high voltage source 34, resulting in an abrupt change of the potential at the electrode 36 to the ground potential. When the spark discharge is interrupted, the potential at the electrode 36 is restored to the initial output potential of the D.C. voltage source 34. Accordingly, if this potential is applied to one end 47 of a pulse shaping resistor 19 (having a resistance of 100 KΩ) having the other end grounded, through a coupling capacitor 16 (having a capacitance of 0.001 μF), then a repetitive high voltage negative pulse having a steep rise and decaying with a time constant of $T_1 = C_{16}.R_{19}$ (0.1 msec.) appears at said one end 47, and thus this negative pulse is applied to the discharge electrode 11 via the output terminal 18 and the conductor 16. In this case, the repetition period T (sec.) of the negative pulses is given by the equation $T = 1/nN$, where $n$ (revolutions/sec.) represents the number of revolutions per second of the disc 41, and N represents the number of protrusion electrodes around the circumference of the disc. By employing a mechanical rotary switch 37 as a pulse generating switch element in the above described manner, it becomes possible to greatly reduce the cost of a pulse source in contrast to employing an electronic switching element such as, for example, an electron tube (switching tube) or a semiconductor element (thyristor).

Upon applying a high voltage negative pulse, a group of negative ions produced by an impluse type negative corona discharge generated from the discharge electrode 11 towards the third electrode 23, are at the subsequent moment driven towards the opposite electrodes 21 owing to the D.C. electric field established between the third electrode 23 and the opposite electrode 21, and in the space (charging space) 48 between these electrodes, the negative ions function to strongly charge the suspended particles in the gas under the influence of an intense electric field E that is about to generate a spark discharge (the charge Q acquired by a particle being proportional to $E^2$). Most of the excess ions are absorbed by the opposite electrodes 21. Accordingly, a negative ion current flowing into the opposite electrode 21 also takes a pulse form, the mean value $i_m$ of the current density $i$ being proportional to the repetition frequency $f$ of the impulse type voltage, so that the mean value $i_m$ can be freely varied over a range or considerable width by varying the number of revolutions per unit time of the disc 41.

Furthermore, the dense negative ion group carrying an impulse type negative ion current is quickly expanded and dispersed as it travels towards the opposite electrode 21 owing to strong Coulomb's repulsion forces therebetween. Consequently, when they reach the opposite electrode 21 they would have a very uniform negative ion current density over the entire locations.

While this negative ion current passes through the dust layer then accumulated on the opposite electrode, it is possible to maintain the condition of $i \times \rho_d < E_b$ by controlling the mean ion current $i_m$ in the above described manner. However, the specific resistivity $\rho_d$ of the dust layer may be increased, that is, it is possible to avoid occurrence of breakdown in the dust layer and thereby prevent generation of an inverse ionization. As described, one of the most significant advantages resulting from a system for charging particles with a repetitive pulse voltage is that the electric field E in the charging space 48 and the ion current density $i$ (as a mean ion current $i_m$) on the opposite electrode 21 can be independently controlled and thereby the ion current density $i$ can be varied in accordance with the magnitude of the specific resistivity $\rho_d$ so as to always maintain the relationship of $i \times \rho_d < E_b$ while the electric field E is always maintained at a high value that is about to generate a spark discharge, and also that a uniform current density can always be obtained over the entire surface of the dust layer. Here it will be recalled that in the conventional system of applying a simple D.C. voltage between a dishcarge electrode and an opposite electrode, the ion current density $i$ is a single-valued function of the electric field E. Thus, when the resistivity $\rho_d$ is increased if the ion current density $i$ is reduced so as to satisfy the condition of $i \times \rho_d < E_b$, the electric field E is necessarily weakened resulting in reduction of the amount of the charge given the particle, materially reducing dust collecting performance. On the contrary, if the electric field E is chosen at a sufficiently large value, then necessarily the relation of $i \times \rho_d < E_b$ is established resulting in generation of an inverse ionization, and so the dust collecting performance is materially reduced. Thus, so long as a dry type of system is employed, there has been no solution for the problems in the prior art. Furthermore, in the case of the D.C. corona discharge, it is impossible to obtain a uniform current density distribution over the entire surface of the opposite electrode, and an inverse ionization would occur at a position where the ion current density $i$ is locally increased. Therefore, such a conventional system had a disadvantage that lowering of the mean value of the ion current density $i$ would not always result in suppression of an inverse ionization.

While it may be generally throught of to directly ground the third electrode 23 at the negative terminal 29 of a D.C. high voltage source 27, according to the present invention the negative terminal 29 is connected to an ungrounded terminal 50 of a negative D.C. voltage source 49 to apply a negative bias voltage to the third electrode 23 with respect to the ground potential. Now this feature of the invention will be described in more detail hereinunder.

As described previously, in a large sized apparatus of practical scale, in view of machining tolerance it is necessary to select a somewhat wider spacing between the sharp end of the discharge electrode 11 and the third electrode 23. As a result, the electrostatic shielding effect of the third electrode upon the discharge portion 12 will be lost, so that even in the case when a pulse voltage is not applied to the discharge electrode 11, a D.C. negative corona discharge occurs continuously from the discharge electrode 11 towards the opposite electrode 21, resulting in continuous flow of an ion current, and thereby the control effect of the repetition frequency $f$ upon the mean value of the current density $i$ is eliminated. In order to avoid such a disadvantage, it is necessary to construct the third electrode so as to satisfy the essential condition that when a pulse voltage is not applied to the discharge electrode 11 the ion current flowing from the discharge electrode towards the opposite electrode 21 may be maintained always at zero, in other words, so as to have a dimension and a configuration suitable for realizing a sufficient electrostatic shielding effect upon the discharge portion 12 of the discharge electrode 11. However, since the electric field intensity for starting a corona discharge at the discharge portion 12 would vary if the temperature, pressure and composition of the gas and the dust concentration should be changed from time to time, even if the structure and arrangement of the third electrode are chosen to satisfy the above described requirements under a certain gas condition, a possibility may often occur that the above described requirements are not satisfied when the gas condition is changed.

In order to overcome the aforementioned difficulties and to satisfy the above described requirements, according to the present invention provision is made such that a variable negative D.C. bias voltage is first applied to the third electrode 23 relative to a reference potential (a potential when a high voltage negative pulse is not applied) of the discharge electrode 11 to thereby control the electric field intensity at the discharge portion 12. In response to change of the gas condition said bias voltage is varied so that a negative corona discharge cannot occur from the discharge portion 12 when a high voltage negative pulse is not applied to the discharge electrode 11 (in other words, so that the electric field at the discharge portion 12 will not reach the corona start electric field intensity). Reference numeral 49 designates a negative D.C. high voltage source, which applies a variable negative D.C. bias voltage relative to the ground potential to the third electrode 23 via its output terminal 50 and a negative output terminal 29 of the voltage source 27 in order to achieve the aforementioned object. The other output terminal of said high voltage source 49 is grounded. Here it is to be again noted that the application of such a bias voltage between the discharge electrode and the third electrode forms a very significant feature of the present invention as described previously.

In order to achieve the aforementioned object, various other methods are available, as for instance, the conductor 26 may be directly connected to the terminal 50 while connecting the terminal 29 directly to the ground rather than to the terminal 50 and the conductor 26. In any case, it is an essential requirement that a D.C. voltage for driving ions be connected between the third electrode 23 and the opposite electrode 21 and simultaneously a variable D.C. bias voltage for contolling the electric field at the discharge portion 12 be applied between the third electrode 23 and the discharge electrode 11. Any circuit system which appropriately satisfies this requirement can be employed.

Reference numeral 51 designates a particle collecting section within the duct 2 provided downstream of the particle charging section 10. In the illustrated embodiment, said particle collecting section 51 comprises a group of vertical, channel-shaped electrodes 53 having a shallow U-shaped, cross-sectional configuration with their openings directed to the downstream side and insulatively supported by insulating tubes 52. These are arranged in a row at an appropriate spacing along a vertical plane perpendicular to the gas flow. Another group of vertical, channel-shaped electrodes 54 having a shallow U-shaped, cross-sectional configuration with their openings directed upstream and disposed in a staggered relationship to and appropriately spaced from said first group of electrodes 53. These are also arranged in a row at appropriate intervals along a vertical plane perpendicular to the gas flow. The insulatively supported upstream electrode group 53 is connected to an output terminal 57 of a negative D.C. high voltage source 56 ( 50 KV ) via a conductor 55 that is insulatively introduced into the duct 2 by means of an insulating tube 52. Within the space (dust collecting space) between said electrode group 53 and the grounded downstream electrode group 54 an electric field is established having such direction that particles which have been first negatively charged in the particle charging section 10 will be driven into the interior 59 of the channel of the downstream electrode group 54.

Accordingly, as a dust-containing gas flows through the space between both electrode groups 53 and 54 as shown by arrows 60, dust particles are removed and accumulated on the inside 59 of the channels, and then, due to mechanical vibration caused by a vibrator device 61, fall into a hopper 5 shielded from the gas flow. During this dust collecting process, a small fraction of dust particles having a positive charge also adhere to and accumulate on the upstream electrode group 53. These particles are also peeled off an caused to fall by applying a mechanical impact with a hammering device 62. Reference numerals 63 and 64 are hammering devices for applying mechanical impacts to the opposite electrode 21 and the third electrode 23, respectively, in the particle charging section 10 to cause the accumulated dust to peel off and fall into a hopper 4 provided thereunder. In the illustrated embodiment, as a result of hammering of the third electrode 23, the discharge electrode 11 is also applied with a mechanical impact.

As a result of hammering of the electrode groups 53 and 54 in the particle collecting section 51, some of the accumulated dust reenters the air stream. However, according to the present invention, to prevent this dust reentry, downstream of the electrode group 54, a group of vertical cylindrical discharge electrodes 66 are disposed each provided with a discharge portion 65 consisting of acicular projections. The electrodes 66 are supported by insulating tubes 67 along a plane in parallel to the back surface 69 of the electrode group 54, and said electrode group 66 is connected to an output terminal 57 of a negative D.C. high voltage source 56 via a conductor 68 that is introduced into the duct 2 through an insulating tube 67. Thereby a D.C. negative corona discharge is generated from said discharge electrode group 66 toward the back surface 69 of said channel-shaped electrode group 54, so that after the re-entrained particles have been recharged they are driven against the gas flow recollected on the back surface 69. Here the particles are coagulated and grow into coarse particles, which are adapted to fall into the hopper 5 provided thereunder upon hammering. Although re-entrainment of the particles is apt to occur in a particle collecting section of a two-stage type electric dust collecting apparatus because an ion current does not flow therein and thus an electric adhesive force is lacking, this re-entrainment can be effectively prevented by the above mentioned means. Thus, it is always possible to achieve a high dust-collecting performance.

Figure 3:
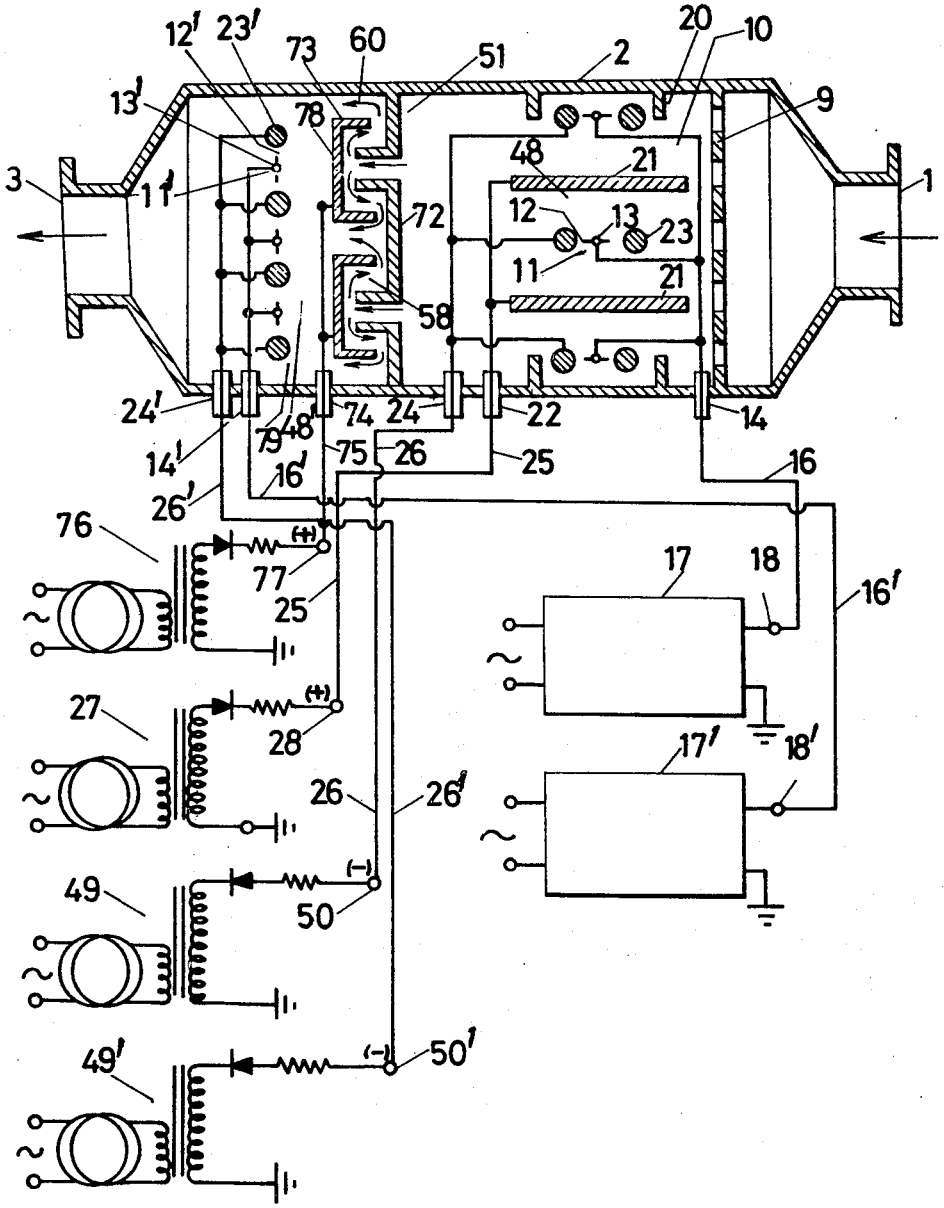
FIG. 3 shows a horizontal cross section view of another embodiment of the present invention.

To achieve the same object, in place of the corona discharge electrode group 66 for generating a D.C. corona discharge as shown in the aforementioned embodiment, obviously the electrode group used in the particle charging section 10 consisting of the discharge electrodes 11 to be applied with repetitive high voltage pulse and the third electrodes 23 disposed in the neighborhood of the electrodes 11, could be employed. In this case, the back surface of the downstream side of channel-shaped electrode group 54 serves the functions of the opposite electrode group 21. Therefore, in the modified embodiment it is necessary to insulatively support said channel-shaped electrode group 54, to apply a positive D.C. high voltage thereto and to ground the upstream side of channel-shaped electrode group 53. FIG. 3 is a horizontal cross section view of the modified embodiment, in which the names and functions of the component elements represented by reference numerals 1 to 51 are exactly the same as those of the component elements bearing the same reference numerals in FIGS. 1 and 2.

In FIG. 3, reference numeral 72 designates an upstream side of channel-shaped electrode group (corresponding to the electrode group 53) which is grounded in this modified embodiment as described above. Also reference numeral 73 designates a downstream side of channel-shaped electrode group (corresponding to the electrode group 54), which is then connected to an output terminal 77 of a positive D.C. high voltage source 76 ( 50 KV ) via a conductor 75 that is insulatively introduced into the duct 2 by an insulating tube 74, so that a positive D.C. high voltage may be applied thereto to establish a particle collecting D.C. electric field in the dust collecting space 58 between said electrode group 73 and the upstream side of channel-shaped electrode group 72. Insulatively disposed downstream of the back surface 78 of said downstream side of channel-shaped electrode group 73 is a discharge electrode group 11' consisting, in the illustrated embodiment, of vertical cylinders 13' having discharge portion 12' (acicular projections in this embodiment), and a third electrode group 23' (cylinders in this embodiment) arranged in the proximity of and in parallel to the discharge electrodes 11'. Both electrode groups 11' and 23' are arranged in the same vertical plane perpendicular to the direction of the gas flow, in parallel to the back surface 78 of the electrode group 73, so as to be exposed in the gas flow. The discharge electrode group 11' and the third electrode group 23' are respectively connected to an output terminal 18' of a repetitive, high voltage, negative pulse source 17' and an output terminal 50' of a variable, negative, D.C. high voltage source 49' ( 40 KV ) through conductors 16' and 26', respectively. Source 17' provides pulses having a peak amplitude of about 14 KV and a frequency range of from 50 to 300 Hz. These conductors are insulatively introduced into the duct 2 by means of insulating tubes 14' and 24'. Thereby, within the space 48' between said third electrode group 23' and the back surface 78 of said channel-shaped electrode group 73, there is established an intense electric field that is about to generate a spark discharge. Simultaneously, an impulsive negative corona current the value of which can always be freely controlled regardless of the electric field as described previously, flows from said discharge electrode group 11' towards said back surface 78 of the electrode group 73, whereby the re-entrained particles will be intensely recharged within the space 48' and strongly driven towards said back surface 78, where said particles are accumulated and grow into coarse particles and thus, further re-entrainment can be completely suppressed. In other words, at this portion of the duct 2, a particle re-entrainment suppressing section 79 is established consisting of the discharge electrode group 11', the third electrode group 23' and the back surface 78 of the electrode group 73. It will be quite obvious, without requiring any further explanation, that during the re-collecting process, even if the specific resistivity of the dust particles to be collected should be very high, an inverse ionization from the dust layer accumulated on said back surface 78 would not occur. Thus, the invention realizes a maximum suppression of the re-entrainment effect. This is a major advantage resulting from the use of the electrode groups 11' and 23' for impulsive charging purposes in this re-entrainment suppression section, too. In this connection, it is obvious that in the circuit arrangement shown in FIG. 3, the negative D.C. high voltage sources 49 and 49', and the high voltage negative pulse sources 17 and 17', respectively, may be replaced by a single, negative, D.C. high voltage source and a single, high voltage, negative pulse source to be used in common.

As will be obvious from the above described embodiments, the two-stage type of electric dust collecting apparatus according to the present invention can provide the following advantages:

1. By employing the application of repetitive high voltage pulses in the particle charging section (and, if desired, the re-entrainment suppression section), the capacity of a high voltage pulse source can be greatly reduced, and also with such an arrangement it is possible to effectively charge a dust having a high resistivity, which essentially could not be charged in the past due to generation of an inverse ionization.

2. Subsequently, in the particle collecting section, dust having a high resistivity can be effectively collected without generating an inverse ionization, by means of only a D.C. electric field without an ion current.

3. As a result, the apparatus can be extremely small sized and also have improved performance.

Of course, in the particle collecting section, there can be employed not only the electrodes having the above described structure and arrangement, but also a conventional parallel plate electrode group insulated from each other, a modification of said parallel plate electrode group in which the respective plate electrodes are disposed as inclined with respect to each other, and other electrodes having any structure and arrangement.

In addition, it is necessary to control the repetition frequency $f$ of the impulsive voltage applied to the discharge electrode 11 in the particle charging section 10, in accordance with the change of the specific resistivity $\rho_d$ of the accumulated dust layer, so that an inverse ionization can never occur. For that purpose, preferably, a detector 70 can be provided for detecting spark discharges generated intermittently between the discharge electrode 11 and the opposite electrode 21 following a commencement of an inverse ionization and the number of revolutions per unit time $n$ of the electric motor 38 can be automatically controlled via a controller 71 so that the occurence frequency of the spark discharge may be maintained within a predetermined range (10–100 times per minute) ($n$ being lowered if the spark generation frequency is too high).

The novel two-stage type of electric dust collecting apparatus according to the present invention is suitable for collecting every dust having a high specific resistivity such as, for example, dusts of limestone, cement clinker and cement kilns, the dust of an iron ore sintering furnace, and the like. Especially with the structure as shown in the illustrated embodiment, it was possible to remove cement clinker dust at a dust removal efficiency of 99.9(%), despite of the fact that the volume of the apparatus used is about one-fourth that of the conventional, single-stage type of electric dust collecting apparatus. Thus, the apparatus according to the present invention provides remarkable performance.

While the features and advantages of the present invention have been described above in connection with a two-stage of electric dust collecting apparatus in which the novel system according to the present invention is applied to the particle charging section, it is obvious that a single-stage type of electric dust collecting apparatus could be constructed so as to include the novel particle charging section only, and in this case also the inverse ionization prevention effect can be obtained.

It has been confirmed that the novel system according to the present invention can effectively overcome even the so-called "corona hindrance effect". When a gas having a high concentration of extra fine particles is introduced to the changing space of a conventional type of system, making use of a D.C. corona discharge, corona discharge is suppressed by the space charge of the charged particles in said gas. The novel system can feed ions independently into the space charge electric field and thus, an excellent dust collecting effect can always be obtained.

In addition, while embodiments of the present invention in which a pulse voltage is used as a periodically varying voltage applied to the discharge electrode have been described above and illustrated in FIGS. 1 to 3, the present invention should not be limited to such type of periodically varying voltages, but instead an A.C. voltage, especially an A.C. voltage whose voltage and/or frequency is variable, could be employed. FIGS. 4 through 8 illustrate these modified embodiments.

Figure 4:
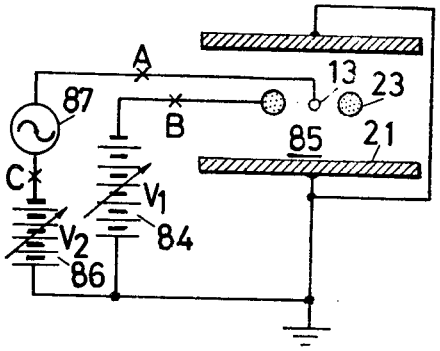
FIGS. 4 through 8 are circuit diagrams showing various examples of the electric power source and its connections to discharge, opposite and third electrodes in case of employing an A.C. voltage as one example of the periodically varying voltage.

In FIG. 4, between third electrodes 23 and opposite electrodes 21 is interposed a D.C. high voltage source 84 to apply a D.C. high voltage $V_1$ therebetween, and thereby within a space 85 between these electrodes there is established a D.C. electric field $E_c$ that is adapted to maintain at all times the electric field intensity in the space between the discharge electrode 13 and the opposite electrodes 21 (hereinafter referred to as a corona space) at such high value that a spark discharge is about to be generated thereby. Between said corona discharge electrode 13 and said opposite electrodes 21 is interposed to D.C. high voltage source 86 to apply a D.C. voltage $V_2$ therebetween, which has the same polarity as the D.C. voltage $V_1$ and a magnitude smaller than the voltage $V_1$. Also at any place in the circuit connecting said corona discharge electrode 13 and said third electrode 23 is serially inserted an A.C. high voltage source 87 to apply an A.C. voltage $V_3 \cos 2\pi ft$ ($f$ representing a frequency of the A.C. voltage source, and $t$ representing time) between said electrodes 13 and 23. Thereby, a periodic corona discharge is generated at said corona discharge electrode 13. Monopolar ions produced by said periodic corona discharge are withdrawn into the corona space between said third electrode 23 and said opposite electrode 21 to establish a periodic monopolar ion current directed towards the opposite electrode 21 and the average current I and, accordingly the following current density $i_d$ can be freely varied by changing the voltages $V_1$, $V_2$ and $V_3$ above and the frequency $f$.

In this way, the corona discharge current I is selected in such manner that the current density $i_d$ (A/m$^2$) of the current flowing through the dust layer adhered to and accumulated on the opposite electrode 21 (this being equal to the ion current density in the corona space at the surface of the dust layer), the virtual specific resistivity $\rho_d$ ($\Omega$–$m$) of said dust layer, and the breakdown electric field intensity $E_b$ (V/m) (this being equal to about $10^6$ (V/m) may satisfy the relation $i_d \times \rho_d < E_b$. Also, by periodically interrupting the ion current, the distribution of the current density $i_d$ on the opposite electrode 21 is made as uniform as possible due to the repulsive dispersion effect of the ion current. By employing an A.C. power source almost all of the power input can be effectively utilized for generating the charging ion current.

More particularly, if the voltage $V_2$ is preset at a value equal in polarity to the voltage $V_1$ and smaller in magnitude than the voltage $V_1$, then the third electrode 23 absorbs most of the lines of electric force running from the opposite electrode 21 to the corona discharge electrode 13 providing an electrostatic shielding effect, so that the electric field intensity on the corona discharge electrode 13 is weakened and eventually the corona discharge extending from this electrode towards the opposite electrode 21 is stopped. In this case, if the value of the voltage $V_1$ relative to the voltage $V_2$ is proper, a corona discharge extending from the corona discharge electrode 13 towards the third electrode 23 also would not occur. Under the above described condition, if an approptiate A.C. high voltage $V_3 \cos 2\pi ft$ is applied between the corona discharge electrode 13 and the third electrode 23, then, in each period of the A.C. voltage there occurs a time interval in which the above described balancing is lost. During this interval the absolute value of the potential at the corona discharge electrode either approaches the absolute value of the voltage $V_1$ or becomes larger than the voltage $V_1$, and a monopolar corona discharge having the same polarity as the voltage $V_1$ is generated from the corona discharge electrode 13 towards the opposite electrode 21. Thereby monopolar ions are emitted from the corona discharge electrode 13. The monopolar ion current I flowing towards the opposite electrode 21 through the above described process, and accordingly the magnitude of the average current density $i_d$, can be freely controlled over a wide range independently of the voltage $V_1$ (accordingly, independently of the electric field intensity $E_c$) by changing the voltages $V_2$ and $V_3$ above and the frequency $f$ and also the distribution of the current density $i_d$ over the opposite electrode 21 is made very uniform. Furthermore, since a pulse source is not used, the input electric power is entirely consumed for the establishment of a charging ion current. Thus, the efficiency of the electric power can be greatly enhanced.

Figure 5:
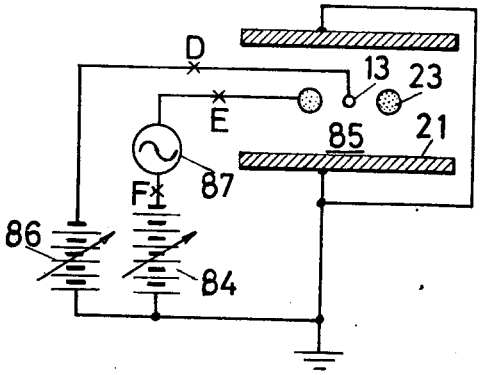
Figure 6:
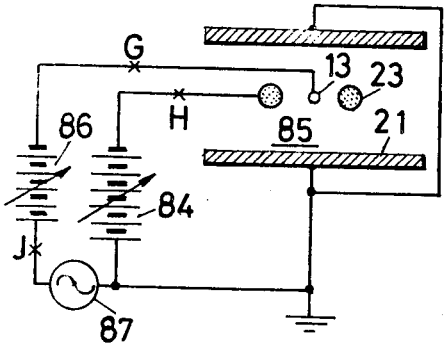
Figure 7:
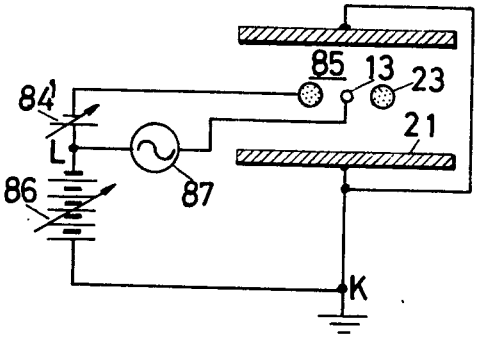
Figure 8:
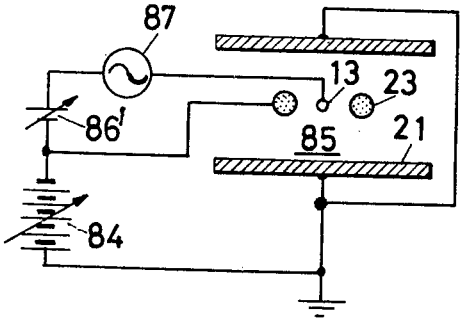

The place where the variable A.C. high voltage source 87 is inserted, is not limited to the position shown in FIG. 4, any position in the circuit connecting the corona discharge electrode 13 and the third electrodes 23 could be selected such as, for example, the positions shown in FIGS. 5 and 6. Source 87 has a peak voltage of 16 KV and a frequency of 60 Hz. In addition, the grounding position in the power supply circuit for the corona discharge system is not limited to the position of the opposite electrodes 21 as shown in FIGS. 4, 5 and 6, but it could be located at any selected position such as, for example, the point A, B or C in FIG. 4, the point D, E or F in FIG. 5, or the point G, H or J in FIG. 6. Still further, with regard to the voltage source 84 for applying a variable D.C. high voltage between the third electrode 23 and the opposite electrode 21 and the other voltage source 86 (0 to 5 KV) for applying a variable D.C. high voltage between the corona discharge electrode 13 and the opposite electrode 21, instead of providing these voltage sources individually they could be constructed so that one may use a part or a whole of the other in common, for instance, as shown in FIGS. 7 and 8. More particularly, in FIG. 7, the voltage source 84 is constructed by serially connecting a variable D.C. high voltage source 84' (0 to 5 KV) to the voltage source 86, while in FIG. 8 the voltage source 86 is constructed by serially connecting a variable D.C. voltage source 86' (0 to 5 KV) to the voltage source 84 (0 to 50 KV). In the case of constructing the voltage source 84 and 86 in such manner that one may use a part of a whole of the other in common as illustrated in FIGS. 7 and 8, it is also obvious that the place where the variable A.C. high voltage source is inserted is not limited to the illustrated positions but could be at any selected position in the circuit connecting the corona discharge electrode 13 and the third electrode 23. In every case of the connection of the variable A.C. high voltage source, the grounding position in the power supply circuit could be at any arbitrary position.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

The embodiments of the invention in which an exclusive property or privilege is claimed are defined as follows:

1. An electric dust collecting apparatus comprising:

a duct having an inlet port for receiving a dust containing gas and a gas outlet port for exhausting cleaned gas;

a particle collecting section in said duct and consisting of at least two positive and negative electrode groups disposed insulatively from each other and opposed to each other so as to intercept a gas flow, and a D.C. high voltage source coupled to said electrode groups for applying a D.C. high voltage between said positive and negative electrode groups wherein one of said electrode groups in said particle collecting section comprises a group of vertical channel-shaped electrodes electrically coupled to said duct and arranged in a row and spaced at equal intervals to each other along a vertical plane with their openings directed towards said outlet port and the other electrode group comprises an insulated group of vertical channel-shaped electrodes arranged in a row at an equal interval to each other along a vertical plane downstream of and in the proximity of said first group of vertical channel-shaped electrodes in a staggered relationship thereto with their openings directed towards said inlet port;

a particle respatter suppressing section positioned in said duct downstream of said particle collecting section and comprising a discharge electrode group disposed along a vertical plane intercepting the gas flow and insulatively supported opposed to the back surface of said channel-shaped electrode group on the downstream side, and a third electrode group having a relatively large radius of curvature and insulatively supported in proximity to said discharge electrode group, a high voltage pulse source coupled between said discharge electrode group and said third electrode group for applying a repetitive impulsive high voltage therebetween;

a particle charging section positioned in said duct and disposed upstream of said particle collecting section and comprising discharge electrodes having a small radius of curvature, opposite electrodes opposed to said discharge electrodes and spaced therefrom, third electrodes having a relatively large radius of curvature and disposed in the proximity of said discharge electrodes, each of said discharge, opposite and third electrodes being insulatively mounted to be exposed in a gas flow, supply means for applying a periodically varying high voltage between said discharge electrodes and said third electrodes, a bias D.C. voltage source for applying a D.C. bias voltage between said discharge electrodes and said third electrodes, and a second D.C. high voltage source for applying a D.C. high voltage between said opposite electrodes and said third electrodes; and detector means for detecting spark discharges generated between said discharge electrodes and said opposite electrode in said particle charging section, and control means coupled to said detector means and to said supply means for controlling the pulse repetition frequency of said supply means so that the occurence frequency of the spark discharge may be maintained within predetermined range.

2. An electric dust collecting apparatus comprising:

a duct having an inlet port for receiving a dust containing gas and a gas outlet port for exhausting cleaned gas;

a particle collecting section positioned in said duct and consisting of at least two positive and negative electrode groups disposed insulatively and spaced from each other and opposed to each other so as to intercept a gas flow, and a D.C. high voltage source coupled to said electrode groups for applying a D.C. high voltage between said positive and negative electrode groups wherein one of said electrode groups in said particle collecting section comprises a group of vertical channel-shaped electrodes electrically coupled to said duct and arranged in a row spaced at equal intervals to each other along a vertical plane with their openings directed towards said outlet port and the other electrode group comprises an insulated group of vertical channel-shaped electodes arranged in a row at an equal interval to each other along a vertical plane downstream of and in the proximity of said first group of vertical channel-shaped electrodes in a staggered relationship thereto with their openings towards said inlet port;

a particle respatter suppressing section positioned in said duct downstream of said particle collecting section and comprising a discharge electrode group disposed along a vertical plane intercepting the gas flow and insulatively supported opposed to the back surface of said channel-shaped electrode group on the downstream side, and a third electrode group having a relatively large radius of curvature and insulatively supported in proximity to said discharge electrode group, a high voltage pulse source coupled between said discharge electrode group and said third electrode group for applying a repetitive impulsive high voltage therebetween;

a particle charging section positioned in said duct and disposed upstream of said particle collecting section and comprising discharge electrodes having a small radius of curvature, opposite electrodes opposed to said discharge electrodes and spaced therefrom, third electrodes having a relatively large radius of curvature and disposed in the proximity of said discharge electrodes, each of said discharge, opposite and third electrodes being insulatively mounted to be exposed in a gas flow, supply means for applying a periodically varying high voltage between said discharge electrodes and said third electrodes, a bias D.C. voltage source for applying a D.C. bias voltage between said discharge electrodes and said third electrodes, and a second D.C. high voltage source for applying a D.C. high voltage between said opposite electrodes and said third electrodes; and detector means for detecting spark discharges generated between said discharge electrodes and said opposite electrodes in said particle charging section, and control means coupled to said detector means and to said bias D.C. voltage source for applying a D.C. bias voltage to said third electrodes to control the output voltage of said bias source so that the occurence frequency of the spark discharge may be maintained within a predetermined range.

3. An electric dust collecting apparatus comprising:

a duct having an inlet port for receiving a dust containing gas and a gas outlet port for exhausting cleaned gas;

a particle collecting section in said duct and consisting of at least two positive and negative electrode groups disposed insulatively from each other and opposed to each other so as to intercept a gas flow, and a D.C. high voltage source coupled to said electrode groups for applying a D.C. high voltage between said positive and negative electrode groups wherein one of said electrode groups in said particle collecting section comprises a group of vertical channel-shaped electrodes electrically coupled to said duct and arranged in a row and spaced at equal intervals to each other along a vertical plane with their openings directed towards said outlet port and the other electrode group comprises an insulated group of vertical channel-shaped electrodes arranged in a row at an equal interval to each other along a vertical plane downstream of and in the proximity of said first group of vertical channel-shaped electrodes in a staggered relationship thereto with their openings directed towards said inlet port;

a particle respatter suppressing section positioned in said duct downstream of said particle collecting section and comprising a discharge electrode group disposed along a vertical plane intercepting the gas flow and insulatively supported opposed to the back surface of said channel-shaped electrode group on the downstream side, and a third electrode group having a relatively large radius of curvature and insulatively supported in proximity to said discharge electrode group, a high voltage pulse source coupled between said discharge electrode group and said third electrode group for applying a repetitive impulsive high voltage therebetween;

a particle section positioned in said duct and disposed upstream of said particle collecting section and comprising discharge electrodes having a small radius of curvature, opposite electrodes opposed to said discharge electrodes and spaced therefrom, third electrodes having a relatively large radius of curvature and disposed in the proximity of said discharge electrodes, each of said discharge, opposite and third electrodes being insulatively mounted to be exposed in a gas flow, supply means for applying a periodically varying high voltage between said discharge electrodes and said third electrodes, a bias D.C. voltage source for applying a D.C. bias voltage between said discharge electrodes and said third electrodes, and a second D.C. high voltage source for applying a D.C. high voltage between said opposite electrodes and said third electrodes; and detector means for detecting spark discharges generated between said discharge electrode and the back surface of said channel-shaped electrode group on the downstream side in said particle respatter suppressing section, and control means coupled to said detector means and to said high voltage pulse source of controlling the pulse repetition frequency of said high voltage pulse source so that the occurence frequency of the spark discharge may be maintained within a predetermined range.

4. An electric dust collecting apparatus comprising:

a duct having an inlet port for receiving a dust containing gas and a gas outlet port for exhausting cleaned gas;

a particle collecting section positioned in said duct and consisting of at least two positive and negative electrode groups disposed insulatively and spaced from each other and opposed to each other so as to intercept a gas flow, and a D.C. high voltage source coupled to said electrode groups for applying a D.C. high voltage between said positive and negative electrode groups wherein one of said electrode groups in said particle collecting section comprises a group of vertical channel-shaped electrodes electrically coupled to said duct and arranged in a row spaced at equal intervals to each other along a vertical plane with their openings directed towards said outlet port and the other electrode group comprises an insulated group of vertical channel-shaped electrodes arranged in a row at an equal interval to each other along a vertical plane downstream of and in the proximity of said first group of vertical channel-shaped electrodes in a staggered relationship thereto with their openings directed towards said inlet port;

a particle respatter suppressing section positioned in said duct downstream of said particle collecting section and comprising a discharge electrode group disposed along a vertical plane intercepting the gas flow and insulatively supported opposed to the back surface of said channel-shaped electrode group on the downstream side, and a third electrode group having a relatively large radius of curvature and insulatively supported in proximity to said discharge electrode group, a high voltage pulse source coupled between said discharge electrode group and said third electrode group for applying a repetitive impulsive high voltage therebetween;

a particle charging section positioned in said duct and disposed upstream of said particle collecting section and comprising discharge electrodes having a small radius of curvature, opposite electrodes opposed to said discharge electrodes and spaced therefrom, third electrodes having a relatively large radius of curvature and disposed in the proximity of said discharge electrodes, each of said discharge, opposite and third electrodes being insulatively mounted to be exposed in a gas flow, supply means for applying a periodically varying high voltage between said discharge electrodes and said third electrodes, a bias D.C. voltage source for applying a D.C. bias voltage between said discharge electrodes and said third electrodes, and a second D.C. high voltage source for applying a D.C. high voltage between said opposite electrodes and said third electrodes; and detector means for detecting spark discharges generated between said discharge electrodes and the back surface of said channel-shaped electrode group on the downstream side of said particle respatter suppressing section, and control means coupled to said detector means and to said bias D.C. voltage source associated with said suppressing section for applying a D.C. bias voltage to said third electrodes to control the output voltage of said source so that the occurrence frequency of the spark discharge may be maintained within a predetermined range.

5. An electronic dust precipitator comprising:

a body duct providing a flow path for dust-containing gas;

a particle charging section positioned in said body and including spaced electrodes and first means coupled to said spaced electrodes for applying a high voltage therebetween for charging dust particles with an electrical charge as the dust-containing gas flows through said body duct;

a particle collecting section positioned in said body duct downstream from said charging section and including collecting electrodes and second means for applying a high voltage therebetween for attracting and collecting charged particles;

a respatter suppression section positioned in said body duct downstream of said collecting section and including electrodes and third means for applying a high voltage to said electrodes for repelling charged dust particles in an upstream direction toward said collecting section; and detector means coupled to said spaced electrodes of said charging section for detecting the existence of arcs therefrom and control means coupled to said detector means and to said first applying means for controlling the voltage frequency of spark discharge of said first applying means to prevent excessive arcing from said spaced electrode.

6. An electronic dust precipitator comprising:

a body duct providing a flow path for dust-containing gas;

a particle charging section positioned in said body and including spaced electrodes and first means for applying a high voltage therebetween for charging dust particles with an electrical charge as the dust-containing gas flows through said body duct;

a particle collecting section positioned in said body duct downstream from said charging section and including electrodes and second means for applying a high voltage therebetween for attracting and collecting charged particles on ones of said electrodes; and a respatter suppression section positioned in said body duct downstream of said collecting section and including electrodes and third means for applying a high voltage to said electrodes for directing and repelling charged dust particles in an upstream direction toward said collecting section.

* * * * *

UNITED STATES PATENT AND TRADEMARK OFFICE

CERTIFICATE OF CORRECTION

PATENT NO. : 3,980,455

DATED : September 14, 1976

INVENTOR(S) : Senichi Masuda

It is certified that error appears in the above-identified patent and that said Letters Patent are hereby corrected as shown below:

Column 4, line 64:

"( 50 VK )" should be --- ( 50 KV ) ---.

Column 8, line 48:

After "These" insert --- dust ---.

Column 10, line 51:

After "pulses" insert --- only ---.

Column 15, line 14:

After "openings" insert --- directed ---.

Column 16, line 27, Claim 3:

After "particle" insert --- charging ---.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*